US006603274B2

(12) United States Patent
Ribarich et al.

(10) Patent No.: US 6,603,274 B2
(45) Date of Patent: Aug. 5, 2003

(54) DIMMING BALLAST FOR COMPACT FLUORESCENT LAMPS

(75) Inventors: Thomas J. Ribarich, Laguna Beach, CA (US); Peter Green, Redondo Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 10/115,613

(22) Filed: Apr. 2, 2002

(65) Prior Publication Data

US 2002/0140373 A1 Oct. 3, 2002

Related U.S. Application Data

(60) Provisional application No. 60/280,118, filed on Apr. 2, 2001, and provisional application No. 60/330,612, filed on Oct. 26, 2001.

(51) Int. Cl.[7] ..... G05F 1/00; H05B 37/02

(52) U.S. Cl. ..... 315/291; 315/194; 315/224

(58) Field of Search ..... 315/224, 291, 315/209 R, 225, 247, 307, 194, 219, DIG. 4, DIG. 7

(56) References Cited

U.S. PATENT DOCUMENTS 5,604,411 A * 2/1997 Venkitasubr ahmanian et al. ..... 315/307
5,751,115 A * 5/1998 Jayaraman et al. ..... 315/225
5,872,429 A * 2/1999 Xia et al. ..... 315/194
6,043,611 A * 3/2000 Gradzki et al. ..... 315/194
6,175,195 B1 * 1/2001 Janczak et al. ..... 315/194
6,486,616 B1 * 11/2002 Liu et al. ..... 315/291

* cited by examiner

*Primary Examiner*—Don Wong
*Assistant Examiner*—Chuc D Tran
(74) *Attorney, Agent, or Firm*—Ostrolenk, Faber, Gerb & Soffen, LLP

(57) ABSTRACT

A fluorescent lamp ballast circuit including a phase cut dimmer connectable to a source of AC power, the selectable phase cut dimmer and an electronic switch having a trigger voltage and a conduction period, when the electronic switch triggers to the end of the half cycle, a rectifying and charging circuit coupled to the output of the phase cut dimmer for providing a DC voltage across a DC bus, a filter circuit receiving the output of said phase cut dimmer and converting the output to a control signal related to the firing angle of the electronic switch; an output stage coupled to the lamp, the output stage having at least one electronic switching device; the ballast control circuit including a control input for changing a frequency of said pulsed power signal, the control input being coupled to said control signal, the control signal varying in accordance with the firing angle of he electronic switch, thereby varying the brightness level of said fluorescent lamp.

51 Claims, 3 Drawing Sheets

IR2156
NC
VCC
VDC
RT
RPH
CT
CPH
VB
HO
VS
LO
CS
SD
COM
Vcc
120 VAC
120 VAC
50
40
60
20

DIMMING BALLAST FOR COMPACT FLUORESCENT LAMPS

CROSS REFERENCE TO RELATED APPLICATION

This application claims the benefit and priority of U.S. Provisional Application Serial No. 60/280,118, filed Apr. 2, 2001 entitled "DIMMING BALLAST FOR COMPACT FLUORESCENT LAMPS" and U.S. Provisional Application Serial No. 60/330,612, filed Oct. 26, 2001 entitled "DIMMING BALLAST FOR COMPACT FLUORESCENT LAMPS" the entire disclosures of which are incorporated herein by reference.

BACKGROUND OF THE INVENTION

It has often been a disadvantage with fluorescent lamp electronic ballasts that they have been unable to be dimmed with a standard (phase cut) type of dimmer, particularly in the case of small integral ballast-lamp combinations commonly used in the home to save energy. This is due to the fact that, where there is no power factor correction, the ballast circuit input consists of a rectification stage followed by a large storage capacitor connected to the AC mains supply that provides the DC bus from which the high frequency half bridge and output section is supplied. In such a system, current is drawn from the mains only near the peak of the mains voltage where the storage capacitor charges and not during the remainder of the mains half-cycle.

Virtually all domestic and professional dimming systems are based on triacs. These devices will conduct once they have been fired, only while current flows in excess of the holding current of the deice. These dimmers work very well with a resistive load such as an ordinary Tungsten filament incandescent light bulb as the triac can be fired at any point during the mains half cycle and will continue to conduct until very close to the end of the half-cycle as current is drawn continuously over this period. In this way the lamp current can be adjusted from maximum to zero.

A basic 120 VAC triac based dimmer circuit is shown in FIG. 1. The neutral side is not shown but is connected directly through to the lamp load.

In this conventional triac based dimmer, the triac is triggered once the charge on capacitor C has exceeded the triac threshold. The phase angle in the half cycle when the triac triggers depends on the setting of the potentiometer VR. The longer the RC time constant, the later in the half cycle when the triac triggers. The amount of power supplied to the lamp will determine its brightness. The later in the half cycle that the triac triggers, the lower the brightness level of the lamp.

When a compact fluorescent lamp ballast is connected to a circuit containing such a dimmer, the triac will only conduct if it is fired at a point during the mains half-cycle when the rectified mains voltage is greater than the storage capacitor voltage. In this instance, the capacitor will be charged to the same voltage and the triac will then switch off. In this way it would be possible to adjust the DC bus voltage of the ballast to some extent by adjusting the triac firing point from 90° to 180°. However this will not provide a satisfactory means of controlling the light output. There is also an additional problem encountered due to the fact that a dimmer of this kind requires an inductor in series with the triac to limit the rise time of the current when the device is fired. Without this inductor, mains current harmonics would be produced at frequencies high enough to cause considerable radiated and conducted interference problems. Since the load presented by a ballast circuit is effectively capacitive, when the triac is fired there will be ringing caused by the resonance of the suppression inductor of the dimmer and the capacitive load. This can cause the triac to fire and then switch off as the ringing output voltage swings above and then below the input voltage causing the current to fall below the holding current. This can occur several times during each half cycle, resulting in severe lamp flicker and loss of control of the output.

SUMMARY OF THE INVENTION

A system has now been developed, based around, for example, the IR2156 integrated circuit, where the ballast is able to operate with minimal flicker over a considerable portion of the adjustment range of a dimmer and the light output may be controlled over this range from maximum output down to around 10%. In this system, the front end of the ballast has been designed so that when the triac in the dimmer has fired, it will remain on continuously until almost the end of the mains half-cycle. In addition to this there is provided circuitry that detects the firing angle of the triac and adjusts the lamp current by changing the switching frequency hence controlling the light output depending on the level set by the dimmer.

It should be noted that if the dimmer is set too low, the triac will never fire when a capacitive load is connected. Also when the ballast is running and the dimmer is turned too low, there will be insufficient bus voltage for the ballast to be able to operate. Because of these factors it is impossible for the ballast to operate over the complete range of adjustment of the dimmer. There will also be some hysteresis so that when the ballast is being dimmed down and reaches the point where the lamp goes out, the dimmer has to be turned back up some way before the lamp will strike again.

BRIEF DESCRIPTION OF THE DRAWING(S)

The invention will be described in greater detail in the following detailed description with reference to the drawings, in which.

DETAILED DESCRIPTION OF EMBODIMENTS OF THE INVENTION

Functional Description

Figure 1:
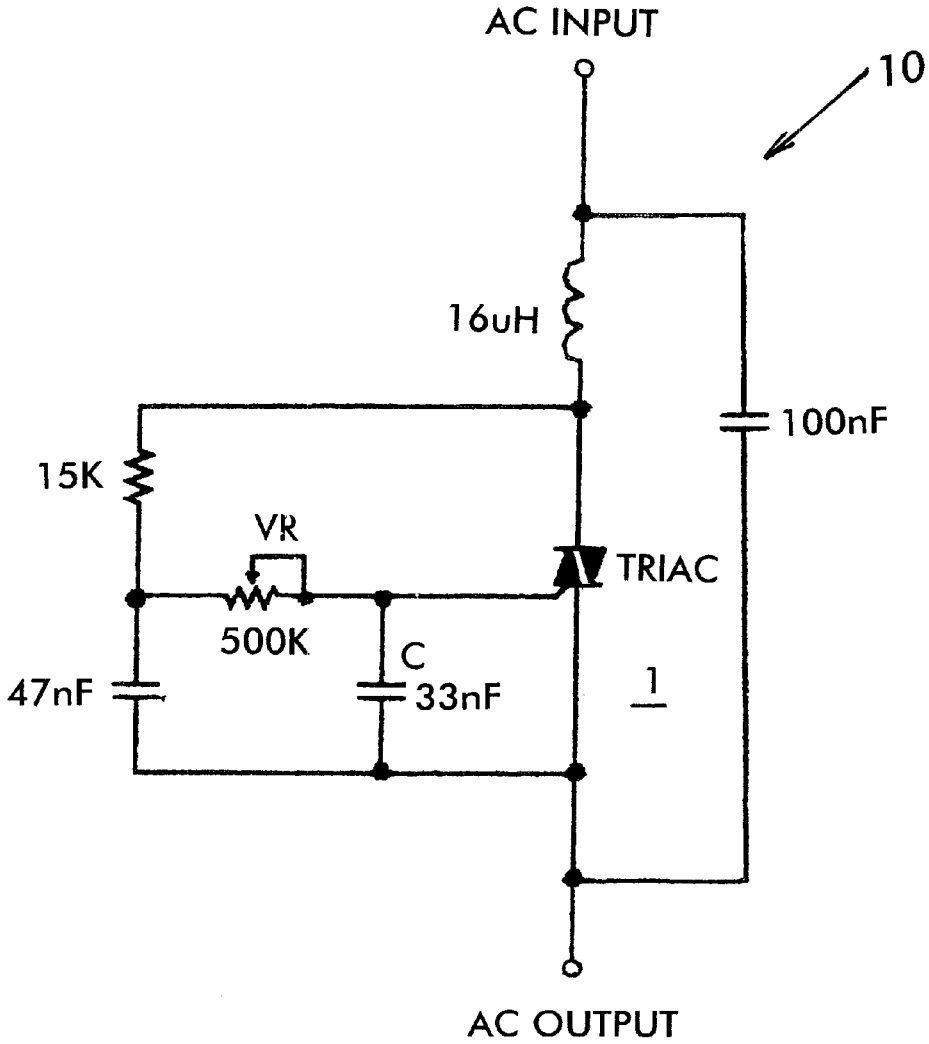
FIG. 1 PRIOR ART
FIG. 1 shows a prior art phase cut dimmer.
Figure 1:
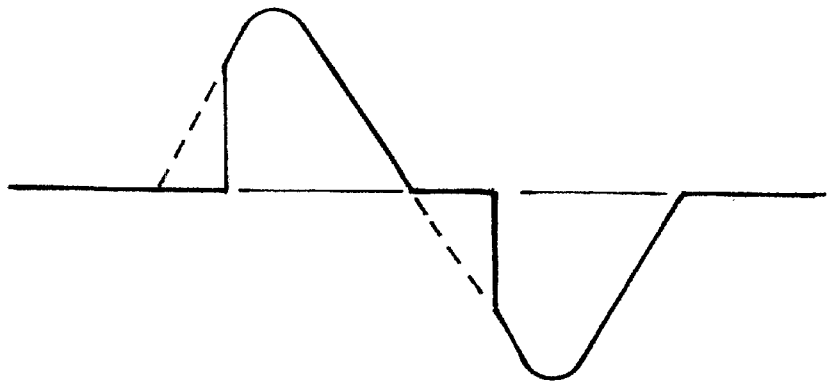
FIG. 1 PRIOR ART
Figure 2:
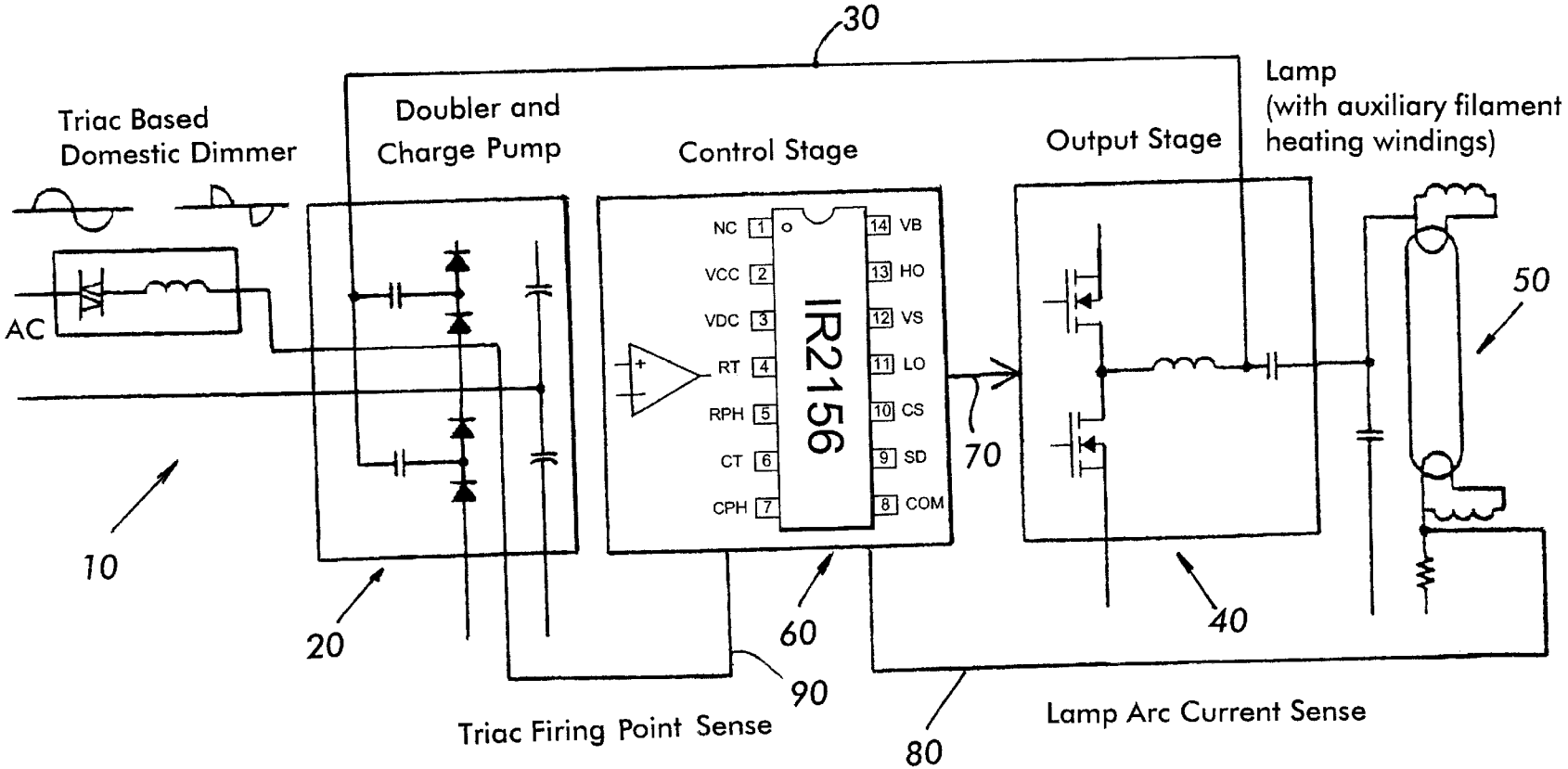
FIG. 2 shows the block diagram of the fluorescent lamp ballast according to the invention which can be dimmed by a phase cut dimmer coupled to its input.

With reference now to the drawings, FIG. 2 shows the basic block diagram of a phase cut dimmable ballast according to the present invention. The ballast includes a phase cut dimmer 10 which can be constructed as shown in FIG. 1, and which is coupled to the AC mains. The output of the dimmer 10 is provided to a voltage doubler and charge pump 20. As shown, the hot side from the AC mains is coupled through the dimmer 10 and the neutral is provided directly into the doubler and charge pump 20. One output of the doubler and charge pump, not shown in FIG. 2, is a DC bus voltage provided to an output stage 40 comprising a half bridge transistor circuit, preferably implemented using FETs. This DC bus voltage is switched by the output stage to power the lamp. An input 30 is provided from the output stage 40 to control the operation of the doubler and charge pump 20. The DC bus voltage is also reduced to provide low voltage power to a control stage 60. The output of the output stage 40 is a pulse train provided to power the fluorescent lamp 50. The control stage 60 has an output 70 for driving the output stage 40. Further, a feedback lamp current sense line 80 is coupled to the control stage 60 and the control stage 60 receives a further input essentially from the dimmer 10 line 90 (via the doubler and charge pump 20) which senses the triac firing point. The control stage 60 may be constructed around the IR1256 ballast controller IC. Control stage 60 includes amplifier/filter circuitry for processing the triac firing point sense input to control the controller IC.

Figure 3:
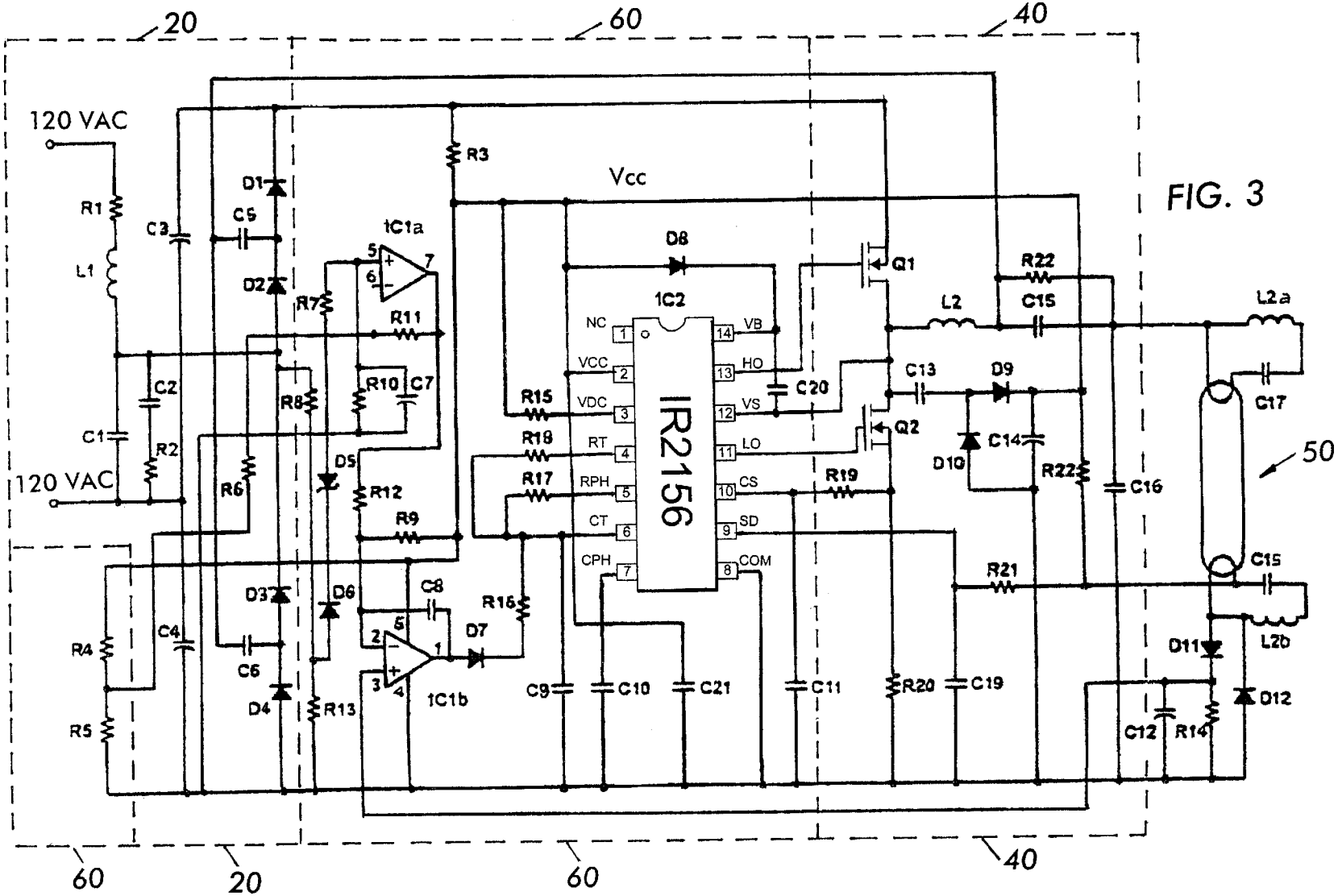
FIG. 3 shows one implementation of a circuit according to the invention.

Turning now to FIG. 3, when the dimmer triac 1 (shown in FIG. 1) is fired, the current that flows must remain above the holding current until a point close to the end of the mains half cycle at which the voltage is very low. This is achieved by ensuring that the ballast draws current exceeding the holding current of a standard power triac as used in most dimmers with a charge pump circuit comprising capacitors C5 and C6 in conjunction with diodes D1 to D4 (not to be confused with the charge pump that supplies the Vcc for the control IC2). When the ballast is operating, the point between L2 and C15 in the output stage 40 swings low when Q2 is on. This charges C5 through D2 during the positive half-cycle of the mains voltage. When Q2 switches off and Q1 switches on, the voltage between L2 and C15 swings high causing C5 to be discharged through D1 into the storage capacitor C3. During the negative half-cycle of the mains voltage, the opposite happens with C6 and C4 with C6 discharging through diode D4 into C4. The result is that a continuous series of current pulses are drawn from the AC input during the period when the triac has been fired until close to the end of the mains half-cycle. The inductor L1 ensures that a continuous current is drawn from the input and that the triac does not switch off between pulses. In order to do this, the inductor must store energy when current is being drawn via the charge pump and release this energy during the period when C5 or C6 is discharging. When the ballast is dimmed, the frequency increases and so the current in C5 or C6 also increases, ensuring that there will be sufficient current to keep the triac switched on at all dim levels. A snubber has also been included consisting of C2 and R2. The purpose of this is to reduce ringing caused by the resonance of the series inductors and load capacitances when the dimmer triac fires. R1 is also important to achieving this and it is important to select L1 such that it has a DC resistance of about 5 Ohms to provide additional damping. If the series resistance of L1 and R1 is too low, the ballast will not be stable at low dimming levels.

The voltage waveform at the junction of D2 and D3, ignoring high frequency components, is equivalent to the output voltage of the dimmer. With respect to the negative rail of the DC bus this will be a phase cut approximate sine wave with a DC offset such that the negative peak is at 0V. This is reduced by the voltage divider network of R8 and R13 which is then fed into diode D6 and zener D5.

Only the signal representing the positive half-cycle of the AC mains is left at the anode of D5 which is then converted to a DC level via the filter network of R7, R10 and C7. Because the minimum dimming level occurs at a point where the dimmer is still capable of providing enough output for the ballast to operate, this voltage will never actually be zero. Also when the dimmer is at maximum, this maximum voltage will only be approximately 3 times the level at minimum dimming level. Since a reference voltage to control the lamp current in a closed loop system is required, it is clear that this would only allow dimming down to one third of the lamp current which is not sufficient range. For this reason an offset stage comprising IC1*a* has been added. The inverting input of op amp IC1*a* is connected to a reference voltage determined by R4 and R5 divided down from the IC supply voltage VCC which is clamped at around 15.6V by the IR2156. The gain of the op amp IC1*a* is positive and set by the ratio of R11 and R6.

If the voltage at the non-inverting input of op amp IC1*a* is Vin and the voltage at the junction of R4 and R5 is Vref, then Vout will be:

(1+R11/R6) Vin−(R11/R6) Vref

In this circuit R6=R11 therefore:

Vout=2Vin−Vref

The values of R4 and R5 have been selected so that when the dimmer is set to minimum the output of IC1*a* will be zero and as the dimmer output is increased the output of IC1*a* will increase to approximately 0.5V. As will be described, the current sense resistor R14 is selected to have a voltage drop of 0.5V when the lamp current is at maximum.

An error amplifier is implemented in IC1*b*. The lamp current feedback from resistor R14 is fed into the non-inverting input and the control voltage from IC1*a* is fed into the inverting input. The input resistors R12 and R14 have been chosen with an integrating capacitor C8 of 10 nF to give the best response and elimination of flicker and to avoid generating RF interference. The output of IC1*b* works as a current source. The more positive the output swings the more current is supplied to the CT pin of the IR2156 (reference IC2) which is added to the current provided by RT causing CT (C9) to charge more quickly and the frequency of operation of IC2 to increase. If IC1*b* output is zero the frequency is at its minimum determined by the value at pin RT only. During preheating of the lamp, the frequency is set by pin RPH only and IC1*b* has no effect. R9 coupled to Vcc ensures that even when the dimming reference voltage from the output of IC1*a* is zero, the error amplifier IC1*b* has a small voltage at the inverting input which means that it is impossible to dim the lamp below a particular point. This point is selected as the minimum lamp level at which the lamp will remain lit and will not flicker. The resistor R22 in the output sage 40 can be added if necessary to remove striations (dark rings) in the lamp that may occur at low dimming levels.

The output stage 40 comprises two power FETs in a half bridge configuration connected between the DC bus through a current sense resistor R20. These transistors are pulse width modulated by the HI and LO outputs from IC2 in conventional fashion. The pulsed output is provided at the common connection of the two transistors to an LC circuit comprising L2, C15 and C16. The lamp 50 is coupled in series with the output inductance L2 and output capacitance C15, and thus provided with a sinusoidal input power at varying frequency, in dependence on the dimming level selected.

Protection Circuits

The SD pin of the IR2156 IC2 is used as lamp removal protection. If there is no lamp present, the voltage at the SD pin will be pulled above the 5.1V threshold via R22 and R21 charging C19. When a lamp is in circuit, the voltage at the junction of R21 and R22 will be held low via D11 and R14. The current sense resistor R20 in series with the half bridge output stage 40 transistors Q1 and Q2 has been selected so that if the lamp fails to strike as the frequency approaches resonance in ignition mode, IC2 will shut down (via pin Cs) thus protecting transistors Q1 and Q2. The VDC pin of IC2 is not used and needs to be tied to VCC via R15. In order for the system to operate, the frequency of the ballast is controlled entirely through the closed loop system.

Layout Issues

Care should be taken when laying out this circuit as with any closed loop control system. There should be a star point for all of the 0V returns, particularly IC1 pin 4, IC2 pin 8, R20, C12, R14, D12, C9, C10, C1 and C14, which is then returned to negative side of C4 via a single track which is as short as possible. This point should also be close to IC2 COM pin 8 as possible and C21 should be located as close to IC2 as possible with short tracks. This will avoid potential ground loop problems.

D1 to D4, C3 and C4 should all be close together with connecting tracks as short as possible. The connecting track from C5 and C6 to the MOSFET half-bridge should also be kept short and as far away from the error amplifier IC1*b* as possible. C14 should be close to IC1 and IC2 with short tracks to the positive supply pins to provide maximum decoupling. All tracks carrying HF currents in the output section should be kept away from IC1 and IC2 and associated components.

Component Selection

The output inductor L2 and capacitor C15 values should be chosen for the ballast to allow it to run at maximum brightness around 40 kHz. This will minimize losses in the inductor. For this example, the IR Ballast Design Assistant software has been used to select the required preheat, ignition and run frequencies for a TC-DEL 26W lamp giving an L of 2.3 mH and C of 6.8 nF. In this circuit the two capacitors C5 and C6 add to the tank capacitance so in practice a 4.7 NF output capacitor (C15) is sufficient. The values of R16, R17 and C9 have been calculated to give a preheat frequency of 55 kHz and a run frequency of 40 kHz. The ignition frequency will be around 45 kHz. Examples of component sizes and part numbers are given in the provisional application files from which priority in this application is claimed.

Output Inductor Design

The output inductor L2 should be designed to allow a high peak ignition current without saturating. This is important as the IR2156 shutdown will be triggered if the inductor saturates. The ignition current depends on the type of lamp being used and must be kept to a minimum by ensuring the preheat is correct. To minimize losses in the inductor, multi-stranded wire should be used in combination with Ferrite cores of sufficiently good quality. The best approach to design is to wind as many turns as possible of multi-stranded wire and have the largest gap possible to achieve the correct inductance. This will produce the highest available peak current before saturating the inductor. It is important to bear in mind that when the cores are hot the saturation point and hence the peak current for the inductor will be lower. Therefore, a poorly designed inductor may result in the ballast shutting down during an attempted hot re-strike.

Lamp Preheating

The lamp must be sufficiently preheated before ignition. The correct preheat current can be determined from published data or from International Rectifier's Ballast Design Assistant software. The preheat time can be set by adjusting the value of C10. As a general rule, the lamp filament should glow red before ignition. If preheat is insufficient the ballast is likely to shutdown during ignition because the output inductor L2 will be unable to operate at the high current required. The number of turns in the auxiliary cathode windings of the output inductor L2 should be chosen to provide sufficient preheat. In designs for ballasts with integral lamps the shutdown pin can be grounded so the inductor may saturate without shutting down the circuit.

The lamp filament (Cathode) resistance over the range of dimming levels must be between 3 and 5.5 times the resistance when cold. A simple method for determining the hot resistance is to first connect one cathode to a DC power supply via an ammeter and slowly increase the voltage from zero, noting the current at 1 volt intervals. This should be done until the cathode can be seen to be glowing red. When this occurs, the voltage should not be increased further in order to prevent possible cathode damage. The resistance can then be calculated for each voltage and hence the acceptable voltage range can be found to comply with the 3 to 5.5 times cold resistance, which can be easily measured with a digital multimeter.

Then, when the ballast is being run, a true RMS digital voltmeter can be connected across one cathode and the voltage can be observed at maximum and minimum brightness. The cathode voltage increases as the ballast is dimmed. The values of C17 and C18 will control by how much it increases. Reducing the capacitance will reduce the amount by which the voltage rises. The values should be chosen to prevent the voltage from exceeding the upper limit at minimum output. It is important to bear in mind that using additional windings on the inductor to provide cathode heating means that power is now being transferred through the core and consequently the core losses will increase and hence the core operating temperature will increase. The core will reach its highest operating temperature when the ballast is running at minimum brightness.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A fluorescent lamp ballast circuit comprising:

a phase cut dimmer connectable to a source of AC power, the phase cut dimmer comprising a user selectable control for setting a brightness level of the lamp and an electronic switch having a trigger voltage and a conduction period, the conduction period of the electronic switch being controlled by the user selectable control whereby to pass a phase cut signal comprising a selectable portion of a half cycle of the AC power from a firing angle when the electronic switch triggers to the end of the half cycle;

a rectifying and charging circuit coupled to the output of the phase cut dimmer for providing a DC voltage across a DC bus and for charging an energy storage device from the selectable portion of the AC power and for drawing a continuous current from the phase cut dimmer during the selectable portion of the half cycle of the AC power;

a filter circuit receiving the output of said phase cut dimmer and converting the output to a control signal related to the firing angle of the electronic switch;

an output stage coupled to the lamp, the output stage having at least one electronic switching device; and a ballast control circuit for driving the output stage, the at least one electronic switching device of the output stage being coupled to said DC bus and being controlled by the ballast control circuit to provide a pulsed power signal to the fluorescent lamp adapted to be coupled hereto, the ballast control circuit including a control input for changing a frequency of said pulsed power signal, the control input being coupled to said control signal, the control signal varying in accordance with the firing angle of he electronic switch, thereby varying the brightness level of said fluorescent lamp.

2. The ballast circuit of claim 1, wherein said control signal is a DC level signal and said filter circuit further comprises an offset circuit for shifting said DC level signal into a shifted DC level signal so that a minimum level of said shifted DC level signal is approximately 0 volts.

3. The ballast circuit of claim 2, wherein said offset circuit for shifting said DC level signal comprises an amplifier and a voltage divider circuit providing a reference voltage to said amplifier whereby when the phase cut dimmer is set to a minimum brightness level, an output of said amplifier will be approximately zero.

4. The ballast circuit of claim 3, further comprising an error circuit coupled between said filter circuit and said ballast control circuit, said error circuit receiving as inputs a first signal from said filter circuit comprising said shifted DC level signal related to a desired brightness level and a second signal related to a current level in said fluorescent lamp, said error circuit comparing said first and second inputs and providing an error signal to said ballast control circuit to drive said lamp to the desired brightness level.

5. The ballast circuit of claim 4, further comprising a lamp current sense circuit coupled to said flourescent lamp for sensing a current level in said lamp and providing a current feedback signal as said second signal to said error circuit.

6. The ballast circuit of claim 2, further comprising a second rectifying circuit coupled between said phase cut dimmer and said filter circuit and providing only a selected half cycle of said phase cut signal to said filter circuit.

7. The ballast circuit of claim 6, wherein said second rectifying circuit provides only the positive half cycle of said phase cut signal to said filter circuit.

8. The ballast circuit of claim 1, wherein said rectifying and charging circuit comprises a voltage doubling circuit, said voltage doubling circuit having an output coupled across said DC bus.

9. The ballast circuit of claim 8, wherein said rectifying and charging circuit has a control input from said output stage, and further comprises first and second storage capacitors, said first storage capacitor being charged in response to said control input from said output stage during a positive half cycle of said AC power and said second storage capacitor being charged in response to said control input from said output stage during a negative half cycle of said AC power.

10. The ballast circuit of claim 9, further comprising third and fourth storage capacitors, said third storage capacitor being charged from said first storage capacitor in response to said control input from said output stage and said fourth storage capacitor being charged from said second stage capacitor in response to said control input from said output stage.

11. The ballast circuit of claim 10, wherein the output stage comprises a half bridge output circuit comprising first and second electronic switching devices connected in series across said DC bus, with an output at a common point between said first and second electronic switching devices, said output being coupled to said fluorescent lamp through an LC circuit, and wherein said control input from said power stage to said rectifying and charging circuit comprises a connection to said output.

12. The ballast circuit claim 11, wherein said first and second electronic switching devices comprises a high side device and a low side device, said control input to said rectifying and charging circuit controlling said first and second storage capacitors whereby said first capacitor charges during the positive half cycle of the AC power when said low side device is conductive and said high side device is nonconductive; and when said low side device is nonconductive and said high side device is conductive, said first capacitor discharges into said third capacitor; and further wherein said second capacitor charges during the negative half cycle of the AC power when said low side device is conductive and said high side device is nonconductive; and when said low side device is nonconductive and said high side device is conductive, said second capacitor discharges into said fourth capacitor; thereby providing a DC voltage across said DC bus.

13. The ballast circuit of claim 11, wherein the LC circuit comprises a series circuit comprising an inductor and a capacitor, the flourescent lamp being coupled in series with said series circuit.

14. The ballast circuit of claim 1, further wherein said rectifying and charging circuit draws a continuous current from said phase cut dimmer during the selectable portion of the half cycle of the AC power from the firing angle when the electronic switch triggers to the end of the half cycle.

15. The ballast circuit of claim 1, further comprising an inductance provided between said phase cut dimmer and said rectifying and charging circuit, said inductance maintaining a continuous current draw from said phase cut dimmer to said rectifying and charging circuit during said selectable portion of the half cycle.

16. The ballast circuit of claim 1, further comprising a lamp removal protection circuit for stopping operation of said control circuit if a lamp is not connected to the circuit when power is applied.

17. The ballast circuit of claim 16, wherein the lamp removal protection circuit comprises an RC circuit including a capacitor that charges above a threshold when the lamp is disconnected when power is applied to the lamp.

18. The ballast circuit of claim 1, further comprising a lamp ignition failure circuit for stopping operation of said control circuit if the lamp fails to ignite as the output signal frequency approaches resonance during ignition mode.

19. The ballast circuit of claim 18, wherein the lamp ignition failure circuit comprises an RC circuit for charging a capacitor above a threshold if lamp current exceeds a preset level.

20. A fluorescent lamp ballast circuit comprising:

a phase cut dimmer connectable to a source of AC power, the phase cut dimmer comprising a user selectable control for setting a brightness level of the lamp and an electronic switch having a trigger voltage and a conduction period, the conduction period of the electronic switch being controlled by the user selectable control whereby to pass a phase cut signal comprising a selectable portion of a half cycle of the AC power from a firing angle when the electronic switch triggers to the end of the half cycle;

a rectifying circuit coupled to the output of the phase cut dimmer for providing a DC voltage across a DC bus;

a charging circuit for charging an energy storage device from the selectable portion of the AC power and for providing a continuous current draw from said phase cut dimmer during the selectable portion of the half-cycle of the AC power;

a filter circuit receiving the output of said phase cut dimmer and converting the output to a DC level signal related to the firing angle of the electronic switch;

a ballast control circuit for driving an output stage comprising at least one electronic switching device, the at least one electronic switching device of the output stage being coupled to said DC bus and being controlled by the ballast control circuit to provide a pulsed power signal to the fluorescent lamp adapted to be coupled hereto, the ballast control circuit including a control input for changing a frequency of said pulsed power signal, the control input being coupled to said DC level signal, the DC level signal varying in accordance with the selectable portion of the AC power provided by said phase cut dimmer, thereby varying the brightness level of said fluorescent lamp.

21. The ballast circuit of claim 20, wherein said filter circuit further comprises an offset circuit for shifting said DC level signal into a shifted DC level signal so that a minimum level of said shifted DC level signal is approximately 0 volts.

22. The ballast circuit of claim 21, wherein said offset circuit for shifting said DC level signal comprises an amplifier and a voltage divider circuit providing a reference voltage to said amplifier whereby when the phase cut dimmer is set to a minimum brightness level, an output of said amplifier will be approximately zero.

23. The ballast circuit of claim 22, further comprising an error circuit coupled between said filter circuit and said ballast control circuit, said error circuit receiving as inputs a first signal from said filter circuit comprising said shifted DC level signal related to a desired brightness level and a second signal related to a current level in said fluorescent lamp, said error circuit comparing said first and second inputs and providing an error signal to said ballast control circuit to drive said lamp to the desired brightness level.

24. The ballast circuit of claim 23, further comprising a lamp current sense circuit coupled to said flourescent lamp for sensing a current level in said lamp and providing a current feedback signal as said second signal to said error circuit.

25. The ballast circuit of claim 21, further comprising a second rectifying circuit coupled between said phase cut dimmer and said filter circuit and providing only a selected half cycle of said phase cut signal to said filter circuit.

26. The ballast circuit of claim 25, wherein said second rectifying circuit provides only the positive half cycle of said phase cut signal to said filter circuit.

27. The ballast circuit of claim 20, wherein said rectifying circuit comprises a voltage doubling circuit, said voltage doubling circuit having an output coupled across said DC bus.

28. The ballast circuit of claim 27, wherein said charging circuit has a control input from said output stage, and further comprises first and second storage capacitors, said first storage capacitor being charged in response to said control input from said output stage during a positive half cycle of said AC power and said second storage capacitor being charged in response to said control input from said output stage during a negative half cycle of said AC power.

29. The ballast circuit of claim 28, wherein said voltage doubling circuit includes third and fourth storage capacitors, said third storage capacitor being charged from said first storage capacitor in response to said control input from said output stage and said fourth storage capacitor being charged from said second stage capacitor in response to said control input from said output stage.

30. The ballast circuit of claim 29, wherein the output stage comprises a half bridge output circuit comprising first and second electronic switching devices connected in series across said DC bus, with an output at a common point between said first and second electronic switching devices, said output being coupled to said fluorescent lamp through an LC circuit, and wherein said control input from said power stage to said charging circuit comprises a connection to said output.

31. The ballast circuit claim 30, wherein said first and second electronic switching devices comprises a high side device and a low side device, said control input to said charging circuit controlling said first and second storage capacitors whereby said first capacitor charges during the positive half cycle of the AC power when said low side device is conductive and said high side device is nonconductive; and when said low side device is nonconductive and said high side device is conductive, said first capacitor discharges into said third capacitor; and further wherein said second capacitor charges during the negative half cycle of the AC power when said low side device is conductive and said high side and device is nonconductive; and when said low side device is nonconductive and said high side device is conductive, said second capacitor discharges into said fourth capacitor; thereby providing a DC voltage across said DC bus.

32. The ballast circuit of claim 30, wherein the LC circuit comprises a series circuit comprising an inductor and a capacitor, the flourescent lamp being coupled in series with said series circuit.

33. The ballast circuit of claim 20, wherein said rectifying circuit and said charging circuit draw a continuous current from said phase cut dimmer during the selectable portion of the half cycle of the AC power.

34. The ballast circuit of claim 20, further comprising an inductance provided between said phase cut dimmer and said rectifying circuit, said inductance maintaining a continuous current draw from said phase cut dimmer to said rectifying circuit during said selectable portion of the half cycle of the AC power.

35. The ballast circuit of claim 20, further comprising a lamp removal protection circuit for stopping operation of said control circuit if a lamp is not connected to the circuit when power is applied.

36. The ballast circuit of claim 35, wherein the lamp removal protection circuit comprises an RC circuit including a capacitor that charges above a threshold when the lamp is disconnected when power is applied to the lamp.

37. The ballast circuit of claim 20, further comprising a lamp ignition failure circuit for stopping operation of said control circuit if the lamp fails to ignite as the output signal frequency approaches resonance during ignition mode.

38. The ballast circuit of claim 37, wherein the lamp ignition failure circuit comprises an RC circuit for charging a capacitor above a threshold if lamp current exceeds a present level.

39. A method of dimming a fluorescent lamp comprising:

applying an AC power source waveform to a phase cut dimmer;

triggering on an electronic switch of the phase cut dimmer at a selected point in a half cycle of the AC power source waveform, thereby providing a phase cut signal, the selected point being related to a desired dimming level of the fluorescent lamp;

rectifying said phase cut signal and charging a storage device to thereby generate a DC power supply voltage across a DC bus;

continuously drawing current from said electronic switch of the phase cut dimmer from the selected point in the half cycle of the AC power source waveform to the end of the half cycle;

filtering at least a portion of the phase cut signal to provide a control signal related to the desired dimming level;

providing the control signal to a ballast control circuit for driving at least one output electronic switch to provide a pulsed power signal comprising pulses of said DC power supply voltage;

providing said pulses of said DC power supply voltage to said fluorescent lamp.

40. The method of clam 39, wherein said control signal comprises a DC level control signal.

41. The method of claim 40, further comprising level shifting said DC level control signal so that a minimum brightness level corresponds to a shifted DC level control signal of substantially zero.

42. The method of claim 41, further comprising providing a lamp current signal related to electrical current in said fluorescent lamp, comparing said lamp current signal to said shifted DC level control signal and generating an error signal to drive said ballast control circuit thereby causing said fluorescent lamp to assume a brightness level in accordance with said shifted DC level control signal.

43. The method of claim 40, wherein said step of filtering further comprises passing only one of the positive and negative half cycles of said phase cut signal to produce said DC level control signal.

44. The method of claim 39, further comprising providing said pulses of said DC power supply voltage to said lamp through an LC circuit.

45. The method of claim 39, wherein the steps of rectifying and charging comprise using a voltage doubling circuit to rectify said phase cut signal, and charging a capacitor to provide the DC power supply voltage to the DC bus.

46. The method of claim 45, wherein said steps of rectifying and charging comprise controlling the passage of said phase cut signal into a charging circuit in dependence on a conduction state of said at least one output electronic switch.

47. The method of claim 46, wherein said steps of rectifying and charging comprise:

charging a first storage capacitor in response to the conduction state of said output electronic switch during a positive half cycle of the AC power source waveform; and charging a second storage capacitor in response to the conduction state of said output electronic switch during a negative half cycle of the AC power source waveform.

48. The method of claim 47, further comprising:

charging a third storage capacitor from said first storage capacitor in response to said conduction state of said output electronic switch; and charging a fourth storage capacitor from said second storage capacitor in response to said conduction state of said output electronic switch.

49. The method of claim 48, wherein the output electronic switch comprises a pair of output electronic switches arranged in a half bridge configuration across the DC bus, said pair of output electronic switches comprising a high side device and a low side device, further comprising:

controlling said first and second storage capacitors whereby said first capacitor charges during the positive half cycle of the AC power when said low side device is conductive and said high side device is nonconductive; and when said low side device is nonconductive and said high side device is conductive, said first capacitor discharges into said third capacitor; and further wherein said second capacitor charges during the negative half cycle of the AC power when said low side device is conductive and said high side device is nonconductive; and when said low side device is nonconductive and said high side device is conductive, said second capacitor discharges into said fourth capacitor; thereby providing a DC voltage across said DC bus.

50. The method of claim 39, wherein said ballast control circuit drives a pair of output electronic switches connected in series across said DC bus in a half-bridge configuration, said pair of electronic power switches being pulse width modulated by said ballast control circuit to provide said pulses of said DC power supply voltage to said fluorescent lamp.

51. The method of claim 39, further comprising providing an inductance in a current path for said phase-cut signal to allow said electronic switch of said phase-cut dimmer to continuously pass current during the time following the selected point in the half cycle of the AC power source waveform to the end of the half cycle for rectifying in said step of rectifying and charging.

* * * * *